US006217666B1

(12) United States Patent
Feldbauer

(10) Patent No.: US 6,217,666 B1
(45) **Date of Patent: *Apr. 17, 2001**

(54) COUNTERCURRENT REDUCTION OF OXIDES ON MOVING METAL

(75) Inventor: Stephen L. Feldbauer, Jackson Center, PA (US)

(73) Assignee: Danieli Technology, Inc., Cranberry Township, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/144,003

(22) Filed: Aug. 31, 1998

(51) Int. Cl.[7] ..... C23G 5/00; B08B 1/02; B08B 5/00

(52) U.S. Cl. ..... 134/2; 134/15; 134/17; 134/30; 134/37

(58) Field of Search ..... 134/2, 15, 17, 134/30, 37; 216/58, 76; 156/345 V

(56) References Cited

U.S. PATENT DOCUMENTS

| | | | | |
|---|---|---|---|---|
| 2,619,434 | * | 11/1952 | Kraus et al. | 134/2 |
| 2,625,495 | * | 1/1953 | Cone et al. | 134/2 |
| 3,944,413 | * | 3/1976 | Volk | 75/35 |
| 3,956,010 | * | 5/1976 | Kachik et al. | 134/2 |
| 5,865,875 | * | 2/1999 | Rinker et al. | 75/436 |

* cited by examiner

*Primary Examiner*—Randy Gulakowski
*Assistant Examiner*—Saeed Chaudhry
(74) *Attorney, Agent, or Firm*—Paul A. Beck & Associates

(57) ABSTRACT

Oxides on the surfaces of metal are reduced by directing reducing gases at them in a forceful and turbulent manner in an enclosure. The oxide-bearing surface is heated to at least 900 degrees F.

14 Claims, 3 Drawing Sheets

COUNTERCURRENT REDUCTION OF OXIDES ON MOVING METAL

TECHNICAL FIELD

This invention relates to the reduction and removal of oxides from the surface of metal. The metal containing surface oxides is passed into or through an enclosure, continuously, intermittently, or batchwise, in which it is heated and contacted with reducing gas.

BACKGROUND OF THE INVENTION

Newly formed metal strip, rod, and the like tends to develop oxides on its surface which must be removed before further processing. In the steel industry, this oxide layer is called mill scale. Mill scale is almost universally removed by acid pickling.

Hydrogen and other reducing gases such as carbon monoxide have been used for the reduction of oxides in ores, where they are substantially consumed within a reducing furnace or vessel. Hydrogen is readily burned and can cause explosions under certain circumstances, and carbon monoxide is poisonous and generally considered dangerous unless confined and reacted in a vessel of the type generally contemplated in ore reduction. Moreover, steel strip and many other metal products made continuously move at a rapid pace, increasing the difficulty of conducting the oxide removal process with gases within the time constraints normally imposed. Thus, while the elementary chemical principles of oxide removal and/or reduction by reducing gases are known, an acceptable continuous surface oxide reduction system employing reducing gases has not been forthcoming in the art.

SUMMARY OF THE INVENTION

My process and apparatus provide for three stages or zones for the processing of the moving metal, which may be any metal having oxide on its surface, in any commercially common shape, such as strip or rod. The three basic stages are heating, reducing, and cooling. All three steps take place within an enclosure of the type to be described in more detail below, and under the conditions to be described in more detail below. Heating in the heating zone is accomplished by a combination of a heating element or device to be described below and post-combustion of unreacted reducing gas. Reduction of the oxide scale in the reduction zone is accomplished by assuring a turbulent and/or vigorous application of reducing gas to the surface of the metal, preferably in the presence of elemental carbon; cooling of the metal in the cooling zone prior to its exit from the enclosure is accomplished by the introduction of inert gas along with the unheated reducing gas to contact the reduced surface of the metal just prior to its exit from the enclosure. The metal surface should be cooled to a temperature at which reoxidation is unlikely to occur; in the case of steel strip, this is 500° F. or lower.

DETAILED DESCRIPTION OF THE INVENTION

It is known that the oxide layer on steel strip may contain $Fe_2O_3$, $Fe_3O_4$, and/or FeO, or various ratios of the three oxide forms depending on the conditions in which the product is made and conducted to the next processing stage. $Fe_3O_4$ may pass through the $Fe_2O_3$ stage before it is further reduced to FeO and then completely reduced to iron. Where hydrogen is the reducing agent, water is produced; where carbon is the reducing agent, carbon monoxide is first produced, and where carbon monoxide is the reducing agent, carbon dioxide results. My invention contemplates the use of either hydrogen or carbon monoxide, or any other commercially feasible reducing gas, in the absence of or together with elementary carbon as a supplementary reductant.

Further, the hydrogen may be manufactured within the enclosure or in its immediate vicinity. Examples of the manufacture of hydrogen include known processes for accomplishing the dissociation of methane, and the combustion of methane or other hydrocarbons in such a way as to produce excess hydrogen.

Figure 1:
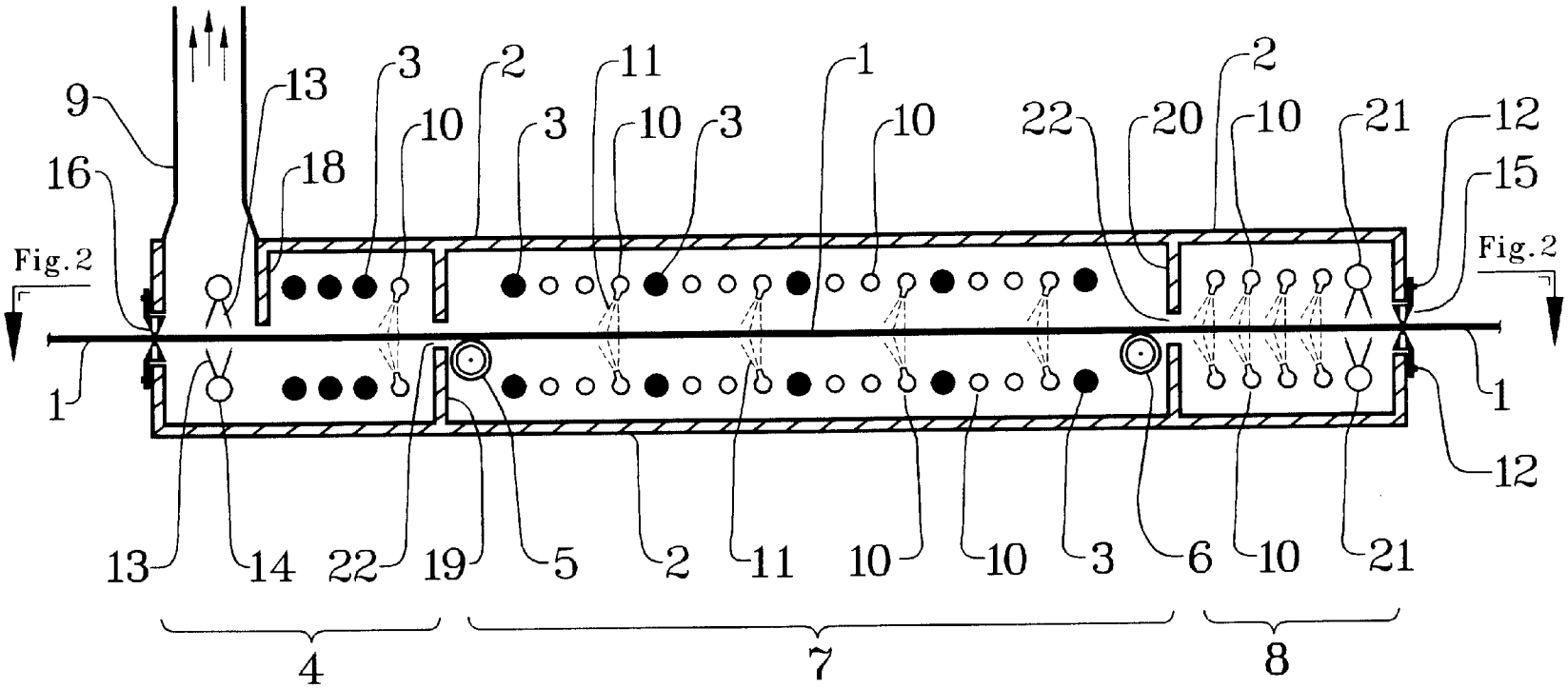
FIG. 1 is a more or less diagrammatic side sectional view of a preferred configuration of the enclosure including all three zones included in my invention, as applied to steel strip.

FIG. 1 illustrates the invention applied to steel strip 1 from which mill scale, or a layer of oxide, must be removed. Steel strip 1 is caused to pass into enclosure 2 in the direction, as depicted, from left to right. It may be held in enclosure 2 for a period of time or moving at a speed up to as fast as 2000 feet per minute. The strip 1 may be preheated before entering enclosure 2, but is heated within enclosure 2 by heating elements 3, preferably radiant heaters, to ensure that the temperature of its surfaces is at least 900° F. by the time it leaves the heating zone, which is designated by the numeral 4.

At the entrance of the strip 1 to the enclosure 2 is a flame 13 and a flue 9 for conducting exhaust gases out of the system. The heating of strip 1 is assisted by the post-combustion of the unconsumed reducing gases by air optionally introduced through inlets 14 in the heating zone 4. Introduction of the air through inlets 14 will cause immediate combustion of whatever reducing gas, usually hydrogen, remains in the atmosphere moving from right to left, as depicted. Preferably the flow of air will be directed at the strip so as to ensure the most efficient use of the thermal energy generated by the combustion, that is, to heat the strip. The action of the flame 13 creates a draft continuously moving gases from right to left, as depicted—from the enclosure strip exit to the strip entrance 16, thus providing a constant countercurrent contact of gas to the strip.

The strip 1, supported by rolls 5 and 6, is then passed into reducing zone 7. Rolls 5 and 6 may be replaced by any suitable support, and also may be replaced by graphite or carbon blocks of a consistency so that a thin film of elemental carbon is deposited or rubbed onto the strip surface, preferably both the top side and the under side. Reducing gas 11, usually hydrogen, is continuously introduced through small apertures 17 (see FIG. 2) in manifolds 10, and directed, preferably at a slight angle of 5–30 degrees, in the direction of the oncoming strip 1 at a velocity to create turbulence on impact with the strip 1. Where carbon is deposited on the strip, the deposition preferably occurs in the upstream half of the reducing zone 7, so there will be time for it to react with the oxides on the surface of strip 1. This zone is called the reducing zone because a large part of the reduction of the oxides occurs in this zone, but it should be understood that some oxide may be reduced in the heating zone 4 due to the continued presence there of at least some reducing gas, and in the cooling zone 8 in part because of the continued presence of reducing gas carried into the cooling zone 8 by strip 1. In the reducing zone 7, the temperature of the surfaces of the strip in maintained at the temperature necessary for the reducing reaction to take place. In the case of steel strip, this is above 900° F.

Moving on, the strip 1 passes into the cooling zone 8. In cooling zone 8, the strip 1 is caused to cool by the introduction of new reducing gases through manifolds 10. The reducing gases introduced separately through manifolds 10 may be mixed with inert gases introduced through separate inlets 21 or premixed with the reducing gases. Introduction of inert gases here will minimize the possibility of mixing air with the reducing gases. When used, inert gases may be mixed with the reducing gas in volume ratios of from 1:99 to 99:1. The strip then passes out of enclosure 2 through fabric curtain 12 and may be coiled or further processed in a hot or cold rolling mill, a slitting station, a galvanizing line, or it may be oiled, otherwise processed, or simply coiled.

Figure 2:
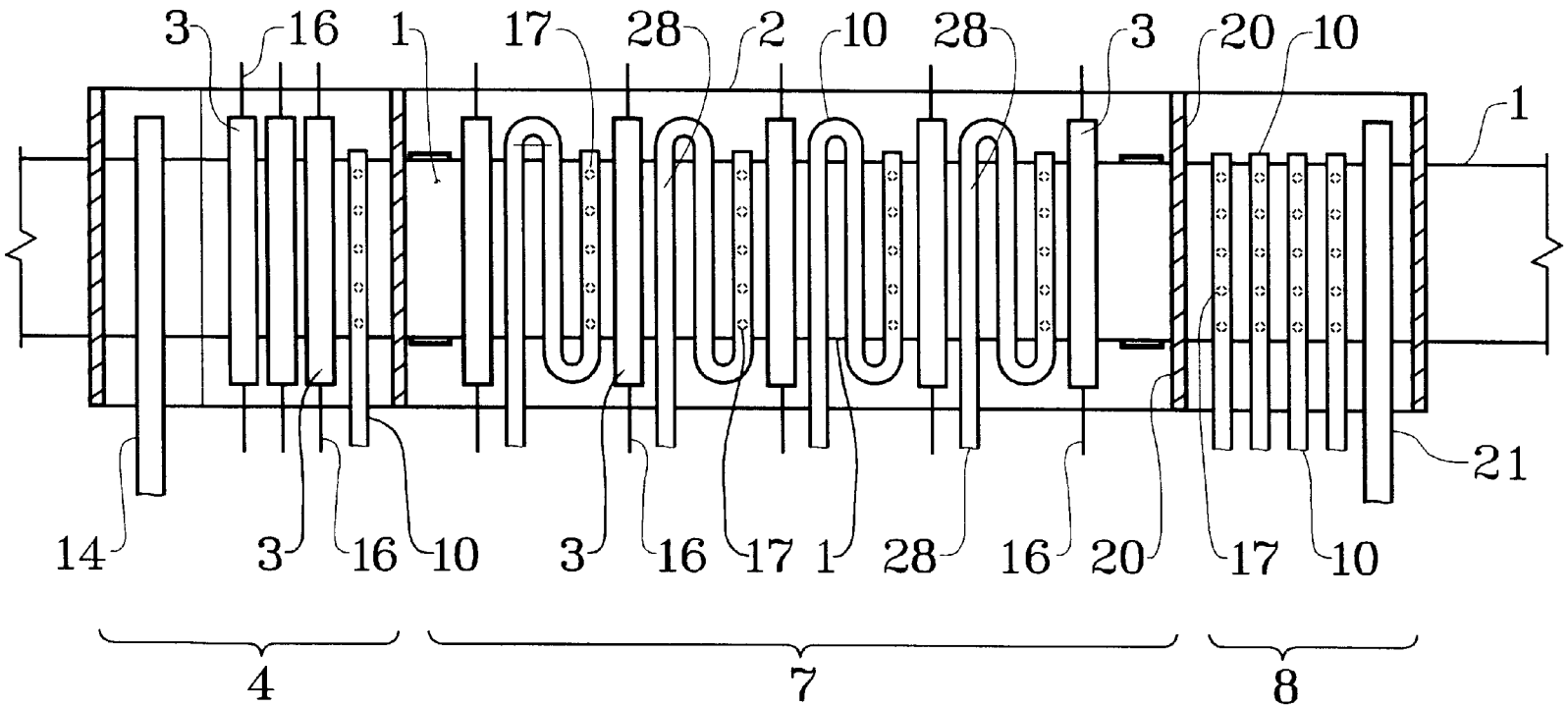
FIG. 2 is an overhead view from within the same enclosure.

FIG. 2 illustrates the parts of enclosure 2 from above heating elements 3 and manifolds 10. Strip 1 is underneath heating elements 3 and manifolds 10. Manifolds 10 are seen to have a plurality of gas apertures 17 for releasing gas. These are on the underside of the manifolds 10 and aimed so the reducing gas may be directed with force toward the strip 1, preferably in the direction from which the strip 1 is traveling. Heating elements 3 have electrical connections 16. Note that divider 18 appears only on the top side of strip 1 (see FIG. 1); dividers 19 and 20 are above and below the strip 1. Preferably the reducing gas manifolds 10 have one or two lengths 28 within enclosure 2 before releasing gas through apertures 17, so the gas can be partially preheated before being released.

Figure 3:
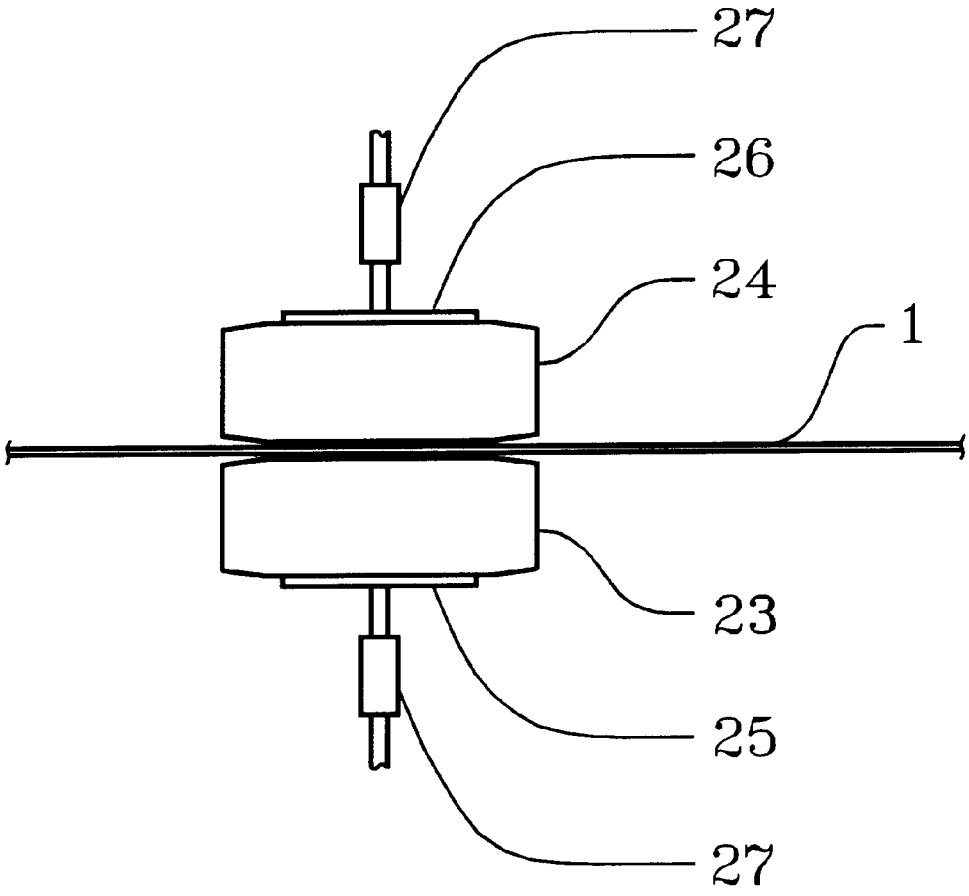
FIG. 3 shows a preferred device for distributing carbon on the strip surface.

FIG. 3 is an optional device for depositing elemental carbon on both sides of strip 1. The device includes carbon blocks 23 and 24 secured to bases 25 and 26, which in turn are connected to pneumatic cylinder 27 made to urge the carbon blocks 23 and 24 toward strip 1. The carbon blocks 23 and 24 may be made of graphite, anode pitch, or any other convenient composition substantially of carbon which will deposit a thin film of carbon on the strip as it passes between the blocks 23 and 24. Alternatively, only one block may be used; in either case the carbon blocks may to some extent replace or supplement the supporting function of rolls 5 and 6 (FIG. 1).

The following guidelines may be used for the treatment of steel strip by my invention, although it should be understood that my invention is applicable to other metals having oxides on their surfaces.

Typically, steel strip will have an oxide layer about 0.009 inch thick, commonly from 0.005 to 0.015 inch, and contain about 1 mole to about 1400 moles of oxygen per square meter of surface. Thus, about 1.1 moles to about 1400 moles of hydrogen, will be required for complete reduction of the oxides. However, it is known that the microstructure of the scale shows numerous small crevices between adherent particles of iron oxide, and a significant portion of the oxide is effectively undermined and loosened by the effect of the reducing fluid. My invention therefore requires that the reducing gas is contacted with the oxide layer in a vigorous, turbulent manner to assure the continuous replenishment of reactants to the metal/oxide surface and continuous convection of the reaction products, i.e. especially water, away from the gas/solid interface. This vigorous, turbulent contacting to enhance the gas phase mass transfer is preferably accomplished by introducing the gas through ports directed toward the surface from which the oxide is to be removed. Because of the undermining and loosening effects mentioned above, it is not necessary for every atom of oxygen to react with a reducing gas; as a significant portion of the oxide will be sufficiently loosened and/or undermined that it can be easily removed mechanically, such as by brushing; in addition, the turbulent action of blowing the reducing gas on the surface of the strip in the strip cooling zone 8 will loosen and remove some of the oxide particles.

To further enhance the reducing reaction in the reducing zone, reducing gas may be introduced directly to the reducing zone after first being preheated. Because gas in the cooling zone is employed partly to cool the strip, the gas introduced there is not to be preheated. Preheating of gas for introduction to the reducing zone may desirably be to a temperature of 900 to 2000° F., and can be accomplished at least partially by directing the fresh reducing gas through extra lengths 28 of manifolds 10 within enclosure 2, where it will pick up heat energy from the environment. Prior to passing into such pipes within the enclosure, the gas may be partially preheated by any suitable means.

Only the surface need be heated to the desirable reduction reaction temperature. Suitable devices for heating are radiant tubes, induction coils, and gas burners. By heating of the surface, 1 mean the oxide layer, which may be from to 0.005 inch thick to 0.01 inch thick, on steel strip , and seldom more than 0.015 inch. Thus, temperatures of 900° F. need not extend to a depth of more than 0.017 inch and, in most cases, 0.015 inch will be sufficient.

In addition to the heating methods and means mentioned above, heating of the reducing gas may be accomplished by passing it through passages in heated carbon blocks.

It will be noted that my invention contemplates a use of the reducing gases to a such degree of efficiency that no recycling is necessary. Recycling of the exhausted reducing gas stream would require removal of the chief reduction product, water, from the gas to be recycled, which is very difficult to do to the extent necessary. Likewise, it would mean cooling the recycled reducing gas, thus setting up a continuous process of heating and cooling of the reducing gas. Rather, my invention contemplates the efficient use of the reducing gas in enclosure 2 by inducing turbulence and direction of the gas onto the surface of the metal to assure continuing contact and replacement of gas and reduction products on the surface. Preferably at least 50%, and most preferably at least 90%, of the reducing gas introduced to the enclosure is consumed in the reduction reaction, and the rest is consumed in flame curtain 13.

What is claimed is:

1. Method of continuously reducing oxides in mill scale on the surface of hot rolled steel strip comprising continuously moving said hot rolled steel strip through an enclosure having an entrance and an exit for said hot rolled steel strip, heating at least the surface of said hot rolled steel strip in a heating zone near said entrance of said enclosure, introducing reducing gas to a cooling zone near said exit of said enclosure, directing said reducing gas toward said surface of said hot rolled steel strip in a vigorous and turbulent manner in a reducing zone in said enclosure, and burning unreacted reducing gas below a flue near said entrance for said hot rolled steel strip to create a draft of said reducing gas in said enclosure countcrcurrent to the movement of said hot rolled steel strip.

2. Method of claim 1 including contacting at least one surface of said metal with elemental carbon.

3. Method of claim 1 wherein said exit for said metal includes a fabric curtain.

4. Method of claim 1 wherein inert gas is mixed with said reducing gas.

5. Method of claim 1 wherein inert gas is mixed with said reducing gas in a ratio of 1:99 to 99:1.

6. Method of claim 1 wherein a portion of said reducing gas is heated before being introduced in said reducing zone.

7. Method of claim 1 whereby said reducing gas is heated within said enclosure before being directed toward said metal.

8. Method of claim 1 wherein said reducing gas comprises hydrogen.

9. Method of claim 1 wherein said reducing gas comprises carbon monoxide.

10. Method of claim 1 wherein at least about 50% of said reducing gas is consumed in reducing said oxides.

11. Method of claim 1 wherein at least about 90% of said reducing gas is consumed in reducing said oxides.

12. Method of claim 1 wherein air is introduced near said entrance to said enclosure to assist in burning said unreacted reducing gas.

13. Method of claim 1 wherein said metal is steel strip.

14. Method of claim 1 wherein said surface is heated to at least 900° F.

* * * * *

UNITED STATES PATENT AND TRADEMARK OFFICE

CERTIFICATE OF CORRECTION

PATENT NO. : 6,217,666 B1
DATED : April 17, 2001
INVENTOR(S) : Stephen L. Feldbauer It is certified that error appears in the above-identified patent and that said Letters Patent is hereby corrected as shown below:

Column 2,
Line 47, after strip exit insert -- 15 --.

Column 4,
Line 23, delete "1" and insert -- I --.
Line 60, delete "countcrcurrent" and insert -- countercurrent --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*